US009962964B2

(12) United States Patent
Ido

(10) Patent No.: US 9,962,964 B2
(45) Date of Patent: May 8, 2018

(54) LIQUID EJECTING APPARATUS AND MEDIUM PRESSING METHOD

(71) Applicant: SEIKO EPSON CORPORATION, Tokyo (JP)

(72) Inventor: Masahiro Ido, Azumino (JP)

(73) Assignee: Seiko Epson Corporation, Tokyo (JP)

( * ) Notice: Subject to any disclaimer, the term of this patent is extended or adjusted under 35 U.S.C. 154(b) by 0 days. days.

(21) Appl. No.: 15/466,627

(22) Filed: Mar. 22, 2017

(65) Prior Publication Data

US 2017/0282599 A1 Oct. 5, 2017

(30) Foreign Application Priority Data

Apr. 5, 2016 (JP) ..... 2016-075617

(51) Int. Cl.

| | |
|---|---|
| ***B41J 11/14*** | (2006.01) |
| ***B41J 2/01*** | (2006.01) |
| ***B41J 11/06*** | (2006.01) |
| ***B41J 3/407*** | (2006.01) |
| ***B41J 11/00*** | (2006.01) |
| ***B41J 15/04*** | (2006.01) |

(52) U.S. Cl.

CPC ..... *B41J 11/14* (2013.01); *B41J 2/01* (2013.01); *B41J 3/4078* (2013.01); *B41J 11/005* (2013.01); *B41J 11/06* (2013.01); *B41J 15/048* (2013.01)

(58) Field of Classification Search

CPC ..... B41J 11/14; B41J 11/06; B41J 2/01

See application file for complete search history.

(56) References Cited

FOREIGN PATENT DOCUMENTS

| | | | |
|---|---|---|---|
| EP | 2774767 A1 | | 9/2014 |
| JP | 2004230839 A | | 8/2004 |
| JP | 2009-269254 | | 11/2009 |
| JP | 2010-264596 | | 11/2010 |
| JP | 2010264596 A | * | 11/2010 |
| JP | 2016-168759 | | 9/2016 |

OTHER PUBLICATIONS

European Search Report isued in Application No. 17163474 dated Aug. 31, 2017.

* cited by examiner

*Primary Examiner* — Henok Legesse
(74) *Attorney, Agent, or Firm* — Workman Nydegger

(57) ABSTRACT

Provided is a liquid ejecting apparatus that includes a support unit configured to support a medium, an ejection unit configured to eject a liquid onto the medium that is transported while being supported by the support unit, and a plate-like pressing unit configured to press, against the support unit, an end portion in a width direction intersecting with a transport direction of the medium being transported in a region opposing the ejection unit. The pressing unit includes regions with different distances therefrom to the support unit via the medium.

8 Claims, 8 Drawing Sheets

LIQUID EJECTING APPARATUS AND MEDIUM PRESSING METHOD

BACKGROUND

1. Technical Field

The present invention relates to liquid ejecting apparatuses and medium pressing methods.

2. Related Art

Various types of liquid ejecting apparatuses have been used. Among them, such liquid ejecting apparatuses are disclosed that suppress a situation where a medium makes contact with an ejection unit by pressing an end portion in a width direction of the medium against a support unit while transporting the medium.

For example, JP-A-2009-269254 and JP-A-2010-264596 each disclose a liquid ejecting apparatus that includes an adhesive belt configured to support a medium on a support surface thereof to which an adhesive agent is attached, and a plate-like pressing unit configured to press an end portion in a width direction of the medium against the adhesive belt.

SUMMARY

In general, as disclosed in JP-A-2009-269254 as well as JP-A-2010-264596, a pressing unit presses an end portion in a width direction of a medium in a region opposing an ejection unit. This is because it is necessary to suppress a situation where fluff or the like in the end portion of the medium floats from the support unit and makes contact with the ejection unit. As such, in the existing liquid ejecting apparatuses, a distance between the medium and the ejection unit is caused to be long so that the pressing unit will not make contact with the ejection unit. However, when the distance between the medium and the ejection unit becomes long, there are cases in which the landing precision of liquid is lowered, the liquid does not land on the medium so that floating mist is increased, and so on.

In addition, because many of such media are used of which a thickness is not constant in an end portion in a width direction of the medium and the pressing unit is so designed as to make contact with a thick portion of the medium, it is difficult to shorten the distance between the medium and the ejection unit. In a case where the overall pressing unit is formed in a thin plate-like shape so as to shorten the distance between the medium and the ejection unit, an effect to press the medium against the support unit is reduced.

An advantage of some aspects of the invention is to provide a liquid ejecting apparatus, in the case where a liquid is ejected onto a medium of which thickness is not constant in an end portion in a width direction thereof, that presses the end portion of the medium against a support unit with certainty while suppressing a distance between the medium and an ejection unit becoming large.

In order to solve the above issue, a liquid ejecting apparatus according to a first aspect of the invention includes a support unit configured to support a medium, an ejection unit configured to eject a liquid onto the medium which is transported while being supported by the support unit, and a plate-like pressing unit configured to press, against the support unit, an end portion in a width direction intersecting with a transport direction of the medium being transported in a region opposing the ejection unit. The pressing unit includes regions with different distances therefrom to the support unit via the medium.

According to this aspect, the pressing unit includes the regions with different distances therefrom to the support unit via the medium. As such, a relatively thick portion in the end portion of the medium can be pressed by a region of the pressing unit with a long distance to the support unit while a relatively thin portion in the end portion of the medium can be pressed by a region of the pressing unit with a short distance to the support unit. This makes it possible to press the end portion of the medium against the support unit with certainty while suppressing a situation where a distance between the medium and the ejection unit becomes long by causing only the region of the pressing unit that corresponds to the relatively thick portion in the end portion of the medium to be thinned without forming the overall pressing unit in a thin plate-like shape.

The expression "to include regions with different distances therefrom to the support unit via the medium" means that the pressing unit includes a region with a short distance to the support unit and a region with a long distance to the support unit in the case where the medium is pressed against the support unit in a state of the medium being supported by the support unit. Accordingly, in a state of the medium being not supported by the support unit, the region with the short distance to the support unit may make contact with the support unit so that the stated distance may not be present.

A liquid ejecting apparatus according to a second aspect of the invention is such that, in the first aspect, the pressing unit is a plate spring.

According to this aspect, the pressing unit is the plate spring. This makes it possible to constitute the pressing unit with ease.

A liquid ejecting apparatus according to a third aspect of the invention is such that, in the first or second aspect, the pressing unit is so constituted as to be capable of moving along the width direction.

According to this aspect, the pressing unit is so constituted as to be capable of moving along the width direction. This makes it possible to use media of different widths, and also makes it possible to cause the region of the pressing unit with the long distance to the support unit to precisely correspond to a relatively thick portion in the end portion of the medium and the region of the pressing unit with the short distance to the support unit to precisely correspond to a relatively thin portion in the end portion of the medium.

A liquid ejecting apparatus according to a fourth aspect of the invention is such that, in the third aspect, the pressing unit is so constituted as to be capable of moving along the width direction by changing an attachment position thereof through making use of magnetic force.

According to this aspect, the pressing unit is so constituted as to be capable of moving along the width direction by changing its attachment position through making use of magnetic force. This makes it possible to easily move or detach the pressing unit along with an attachment section of the pressing unit or the like including a portion in which a magnet is provided.

A liquid ejecting apparatus according to a fifth aspect of the invention is such that, in the third aspect, the pressing unit is so constituted as to be capable of moving along a slide rail that is provided along the width direction.

According to this aspect, the pressing unit is so constituted as to be capable of moving along the slide rail that is provided along the width direction. This makes it possible to easily move the pressing unit along the slide rail and easily detach only the pressing unit by detaching only the pressing unit from the slide rail.

A liquid ejecting apparatus according to a sixth aspect of the invention is such that, in any one of the first to fifth aspects, the support unit is an adhesive belt configured to support the medium on a support surface thereof to which an adhesive agent is attached, and friction reduction processing is performed on a side of the pressing unit that opposes the support surface.

According to this aspect, the support unit is an adhesive belt configured to support the medium on the support surface thereof to which an adhesive agent is attached. This makes it possible to fix and support the medium with certainty. Further, the friction reduction processing is performed on the side of the pressing unit that opposes the support surface. This makes it possible to suppress a situation where the pressing unit adheres to the support surface in a state of the medium being not supported.

As "friction reduction processing", processing in which a material such as fluorine resin or the like for reducing a coefficient of static friction is disposed, or the like can be cited, for example. In addition, processing to lessen a contact area with the support surface so as to reduce the coefficient of static friction (forming unevenness in the surface or the like) may be performed.

A liquid ejecting apparatus according to a seventh aspect of the invention is such that, in the sixth aspect, the friction reduction processing is performed on the region with the relatively short distance to the support unit, but not performed on the region with the relatively long distance to the support unit.

According to this aspect, the friction reduction processing is performed on the region with the relatively short distance to the support unit, but not performed on the region with the relatively long distance to the support unit. Performing the friction reduction processing tends to increase the thickness of the pressing unit. However, by performing the friction reduction processing only on the region with the relatively short distance to the support unit, a difference in distance to the support unit between the region with the relatively short distance to the support unit and the region with the relatively long distance to the support unit can be maintained. This makes it possible, in the case where a medium having a large thickness difference in an end portion thereof is used, to constitute a portion of the pressing unit corresponding to a relatively thick portion in the end portion of the medium to be thin, thereby making it possible to suppress an increase in the thickness of the pressing unit. In addition, the region with the relatively long distance to the support unit will not make contact with the support surface, thereby making it also possible to suppress the pressing unit adhering to the support surface.

A medium pressing method according to an eighth aspect of the invention is a method for pressing a medium in a liquid ejecting apparatus that includes a support unit configured to support the medium, an ejection unit configured to eject a liquid onto the medium which is transported while being supported by the support unit, and a plate-like pressing unit configured to press, against the support unit, an end portion in a width direction intersecting with a transport direction of the medium being transported in a region opposing the ejection unit. The method includes causing the pressing unit to have regions with different distances therefrom to the support unit via the medium, and causing a region of the pressing unit with a relatively long distance to the support unit to press a relatively thick portion in the end portion of the medium and a region of the pressing unit with a relatively short distance to the support unit to press a relatively thin portion in the end portion of the medium.

According to this aspect, the region of the pressing unit with a relatively long distance to the support unit presses a relatively thick portion in the end portion of the medium while a region of the pressing unit with a relatively short distance to the support unit presses a relatively thin portion in the end portion of the medium. Therefore, only the region corresponding to the relatively thick portion in the end portion of the medium can be made to be thin without forming the overall pressing unit in a thin plate-like shape, and the end portion of the medium can be pressed against the support unit with certainty while suppressing a situation where the distance between the medium and the ejection unit becomes long.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, a recording apparatus as an example of a liquid ejecting apparatus according to an embodiment of the invention will be described in detail with reference to the accompanying drawings.

First Embodiment (FIG. 1-FIG. 6)

First, an outline of a recording apparatus 1 according to an embodiment of the invention will be described.

Figure 1:
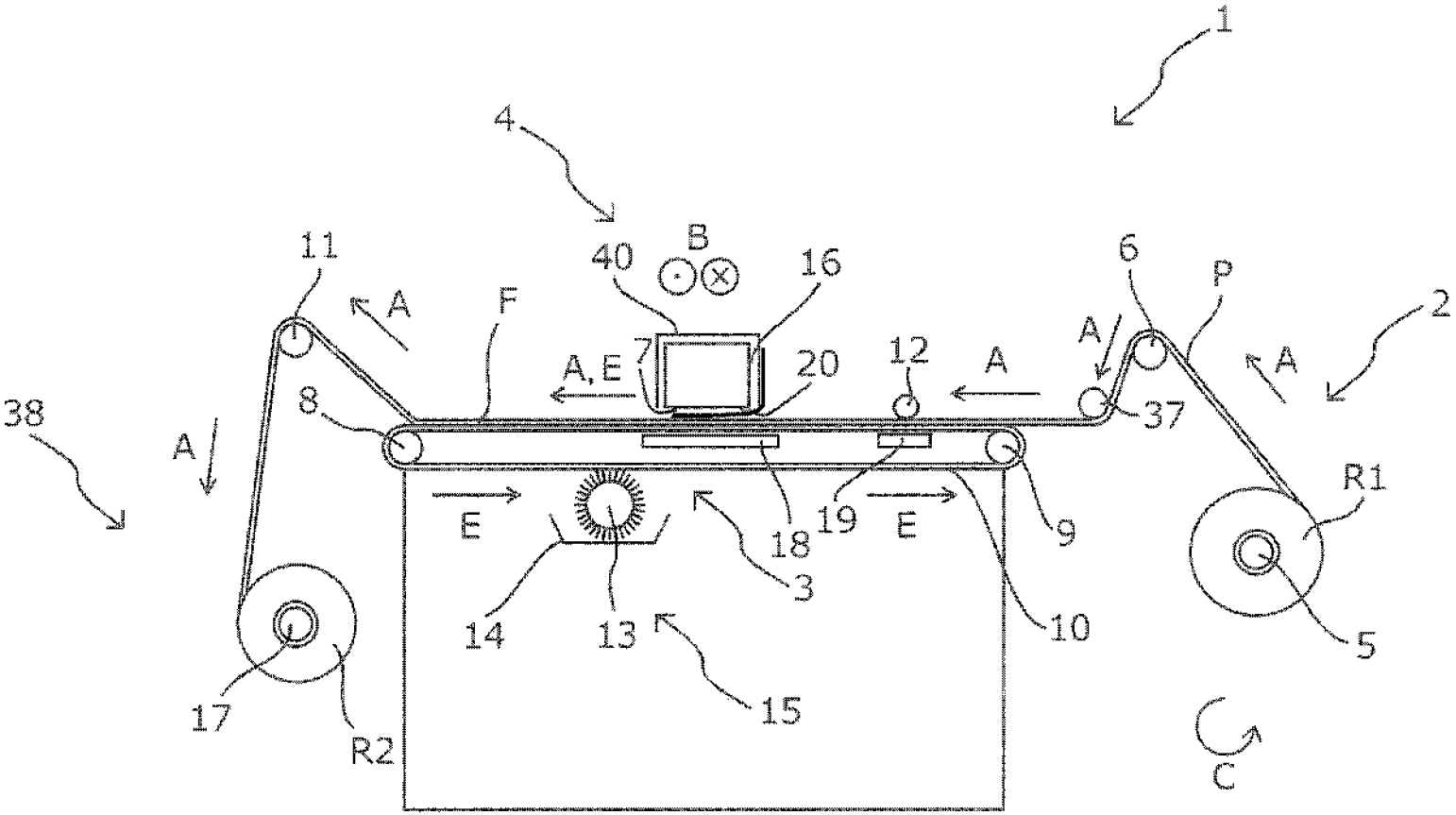
FIG. 1 is a schematic side view illustrating a recording apparatus according to a first embodiment of the invention.

FIG. 1 is a schematic side view of the recording apparatus 1 according to the embodiment.

The recording apparatus 1 of the embodiment includes a feeding section 2 capable of feeding out a roll R1 of a target recording medium (medium) P on which recording is performed; a transport mechanism 3 configured to transport the target recording medium P in a transport direction A using an adhesive belt 10 (a transport belt constituted of an endless belt) that supports the target recording medium P on a support surface F to which an adhesive agent is attached; a recording mechanism 4 configured to record on the target recording medium P by causing a carriage 16 equipped with a recording head 7 for ejecting ink (liquid) to perform reciprocating scanning along a width direction B of the target recording medium P which intersects with the transport direction A of the target recording medium P; a washing mechanism 15 of the adhesive belt 10; and a winding mechanism 38 having a winding shaft 17 for winding the target recording medium P.

The feeding section 2 includes a rotational shaft 5 that serves as a setting position of the roll R1 of the target recording medium P on which recording is performed. The feeding section 2 is so constituted as to be capable of feeding out the target recording medium P from the roll R1 which is set on the rotational shaft 5, via slave rollers 6 and 37, to the transport mechanism 3. The rotational shaft 5 rotates in a rotational direction C when feeding out the target recording medium P to the transport mechanism 3.

The transport mechanism 3 includes the adhesive belt 10 which transports the target recording medium P fed out from the feeding section 2 while placing the target recording medium P thereon, a driving roller 8 for moving the adhesive belt 10 in a direction E, and a slave roller 9. The target recording medium P is pressed against the support surface F of the adhesive belt 10 by a pressing roller 12 to be pasted and placed on the support surface F. The driving roller 8 rotates in the rotational direction C when transporting the target recording medium P.

Note that the endless belt serving as the transport belt is not limited to an adhesive belt. For example, an electrostatic attraction-type endless belt may be used instead.

On a lower side of the adhesive belt 10 of this embodiment, platens 18 and 19 capable of supporting the adhesive belt 10 are provided. By the platens 18 and 19 supporting the adhesive belt 10, vibration of the adhesive belt 10 due to the movement of the adhesive belt 10, or the like can be suppressed. Here, the platen 18 is provided in a region opposing the recording head 7 with the adhesive belt 10 interposed therebetween, and the platen 19 is provided in a region opposing the pressing roller 12 with the adhesive belt 10 interposed therebetween.

The pressing roller 12 of the embodiment is so constituted as to be capable of moving back and forth (swinging) along the transport direction A in order to suppress a situation where a contact mark is formed on the target recording medium P due to the pressing roller 12 making contact with the target recording medium P at the same place for a constant time. Note that, however, the pressing roller 12 is not limited to the above-mentioned constitution.

The recording mechanism 4 includes a carriage motor 30 (see FIG. 2) to move the carriage 16 equipped with the recording head 7 back and forth along the width direction B of the target recording medium P. Note that the width direction B of the target recording medium P is a direction perpendicular to the depiction in FIG. 1.

At the time of recording, recording is performed while making the carriage 16 equipped with the recording head 7 scan back and forth. However, during the scanning in the recording (during the movement of the carriage 16), the transport mechanism 3 stops the transport of the target recording medium P. To rephrase, at the time of recording, the reciprocating scanning of the carriage 16 and the transport of the target recording medium P are carried out alternately. In other words, at the time of recording, in response to the reciprocating scanning of the carriage 16, the transport mechanism 3 intermittently transports the target recording medium P (intermittently moves the adhesive belt 10).

Although the recording apparatus 1 of this embodiment includes the recording head 7 configured to eject ink while moving back and forth along the width direction B of the target recording medium P, a printing apparatus including what is called a line head in which a plurality of nozzles for ejecting ink are provided in an intersection direction intersecting with the movement direction of the target recording medium P may be employed instead.

Here, "line head" refers to a recording head used in a recording apparatus, where a nozzle region formed in the intersection direction intersecting with the movement direction of the target recording medium P is so provided as to be capable of covering the overall area in the intersection direction, and an image is formed by relatively moving the recording head or the target recording medium P. It may not be necessary that the nozzle region formed in the intersection direction of the line head be capable of covering the intersection direction of every target recording medium P to which the recording apparatus corresponds.

The carriage 16 is provided inside a carriage case 40 which is provided extending along the width direction B of the target recording medium P. A pressing unit 20, which is a principal portion of the recording apparatus 1 of the embodiment, is mounted in the carriage case 40. The pressing unit 20 is a constituent member capable of pressing an end portion in the width direction B of the target recording medium P against the support surface F of the adhesive belt 10. Details of the pressing unit 20 will be explained later.

The washing mechanism 15 of the adhesive belt 10 includes a washing brush 13 constituted of a plurality of washing rollers linked in a rotational shaft direction, and a tray 14 containing a washing agent for washing the washing brush 13.

The winding mechanism 38 is a mechanism for winding the target recording medium P, on which recording has been performed, that is transported from the transport mechanism 3 via a slave roller 11. In this case, a paper core or the like for winding the medium is set on the winding shaft 17 and then the target recording medium P is wound thereupon, whereby the target recording medium P can be wound as a roll R2 of the target recording medium P.

Note that FIG. 1 illustrates a state where the roll R1 on which recording is performed on an outside surface is used, and the medium after recording is wound in a roll so that the surface on which the recording has been performed becomes an outside surface of the roll. As such, the rotational shaft 5 and the winding shaft 17 are both rotated in the rotational direction C. However, note that the recording apparatus 1 of the embodiment can use the roll R1 on which recording is performed on an inside surface, and can wind the medium after recording in a roll so that the surface on which the recording has been performed becomes an inside surface of the roll. In other words, both the rotational shaft 5 and the winding shaft 17 can be rotated in a reverse direction to the rotational direction C.

Next, an electric configuration of the recording apparatus 1 of this embodiment will be described.

Figure 2:
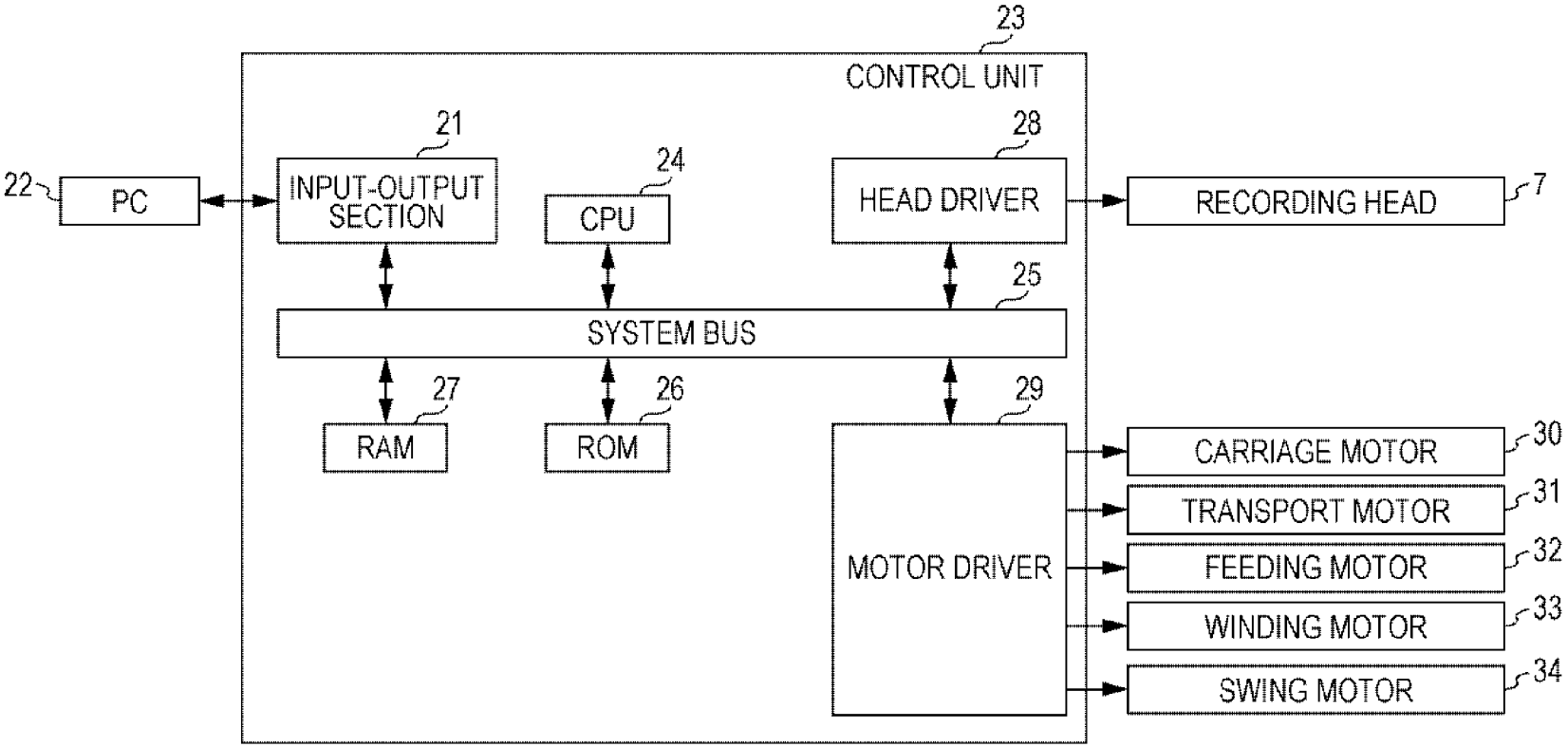
FIG. 2 is a block diagram illustrating the recording apparatus according to the first embodiment of the invention.

FIG. 2 is a block diagram of the recording apparatus 1 of the embodiment.

In a control unit 23, a CPU 24 which supervises the overall control of the recording apparatus 1 is provided. The CPU 24 is connected, through a system bus 25, to a ROM 26 in which various control programs to be executed by the CPU 24, and the like are stored, and to a RAM 27 in which data can be temporarily stored.

Further, the CPU 24 is connected, through the system bus 25, to a head driver 28 configured to drive the recording head 7.

Furthermore, the CPU 24 is connected, through the system bus 25, to a motor driver 29 configured to drive a carriage motor 30, a transport motor 31, a feeding motor 32, a winding motor 33, and a swing motor 34.

The carriage motor 30 is a motor to move the carriage 16 equipped with the recording head 7. The transport motor 31 is a motor to drive the driving roller 8. The feeding motor 32 is a rotation mechanism of the rotational shaft 5, and is a motor to drive the rotational shaft 5 so as to send the target recording medium P to the transport mechanism 3. The winding motor 33 is a driving motor to rotate the winding shaft 17. Then, the swing motor 34 is a driving motor to swing (move back and forth) the pressing roller 12 along the transport direction A.

In addition, the CPU 24 is connected to an input-output section 21 through the system bus 25, and the input-output section 21 is connected to a PC 22 configured to send and receive data, such as recording data and the like, and signals.

The control unit 23, with the above-discussed configuration, can carry out the overall control of the recording apparatus 1.

Next, the pressing unit 20, which is the principal portion of the recording apparatus 1 of the embodiment, will be described.

Figure 3:
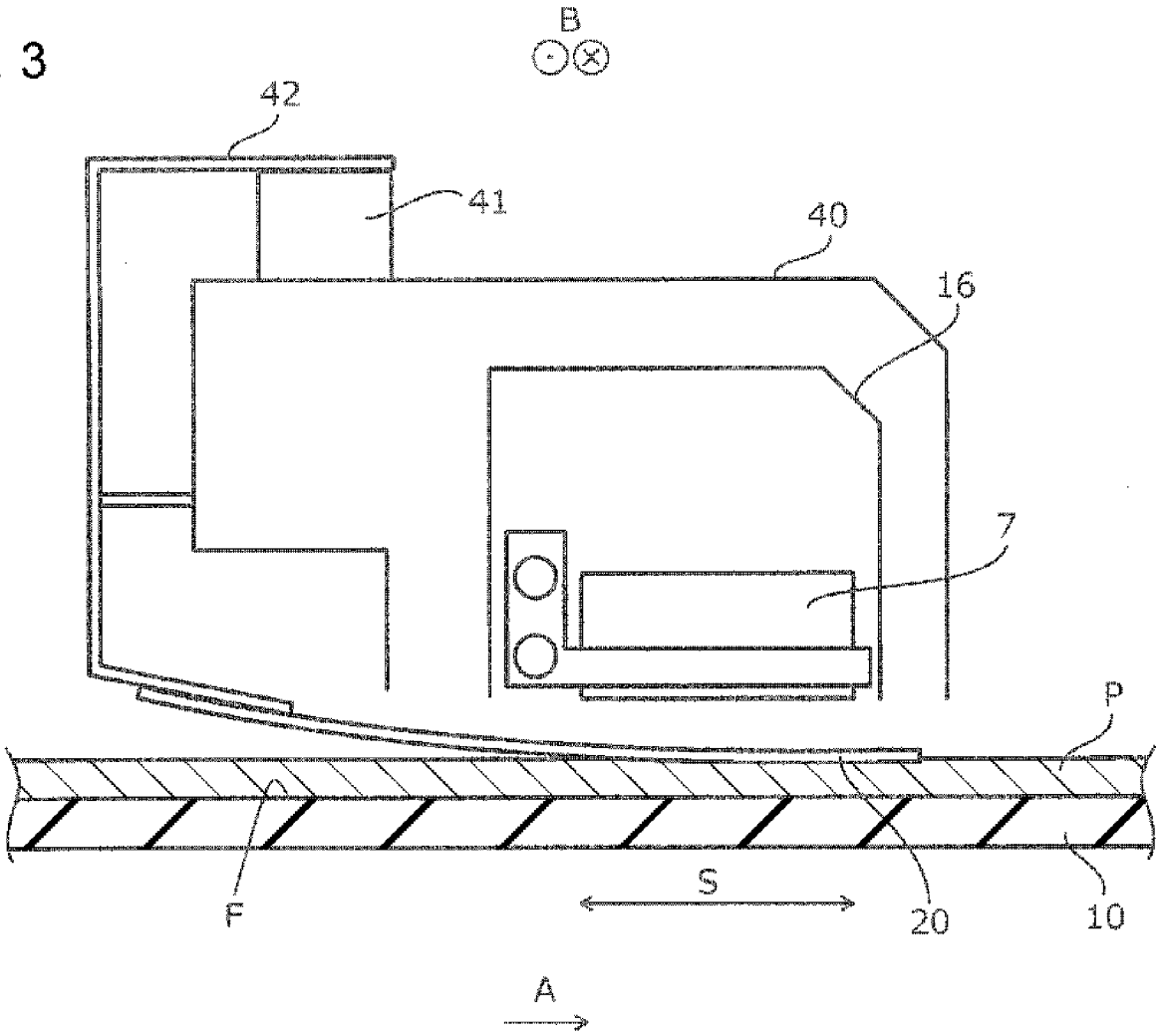
FIG. 3 is a schematic cross-sectional side view illustrating a principal portion of the recording apparatus according to the first embodiment of the invention.
Figure 4:
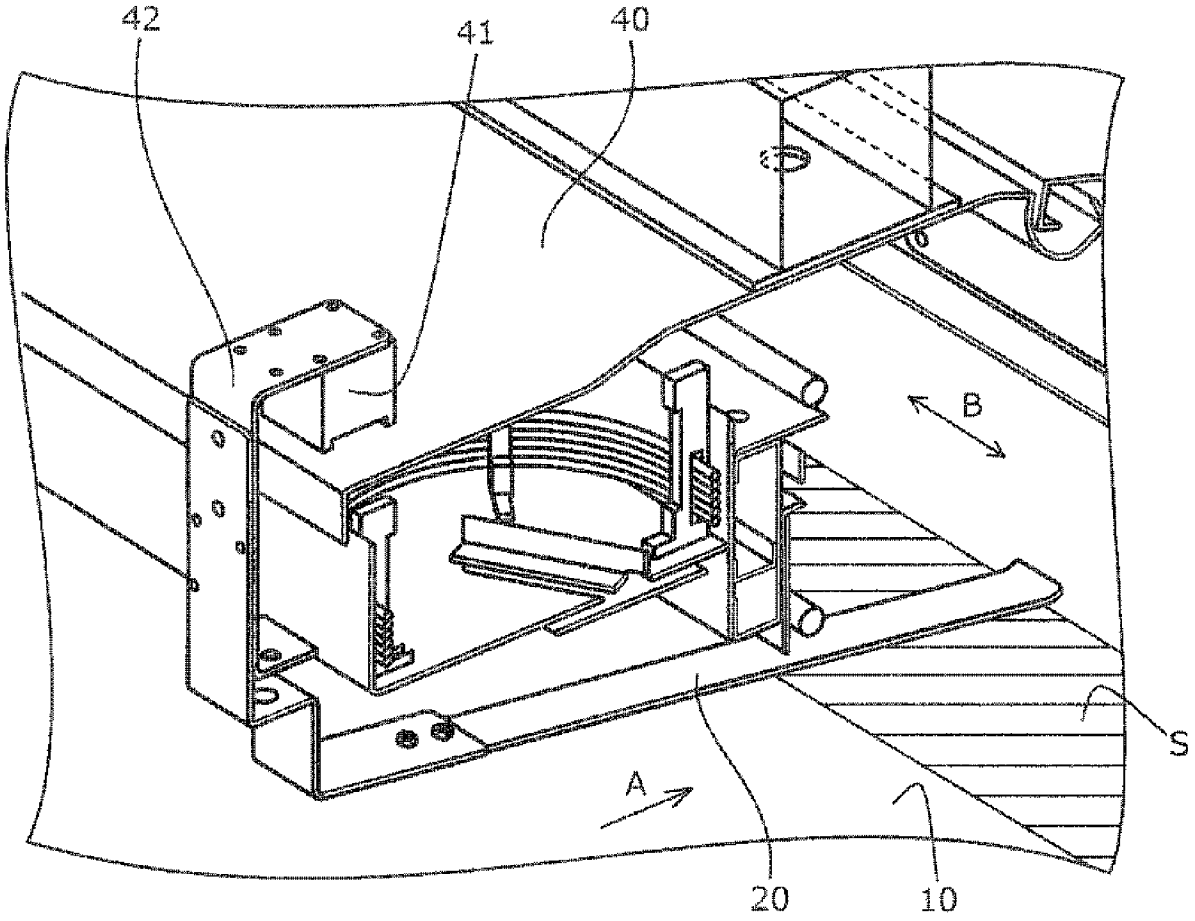
FIG. 4 is a schematic cross-sectional perspective view illustrating the principal portion of the recording apparatus according to the first embodiment of the invention.
Figure 5:
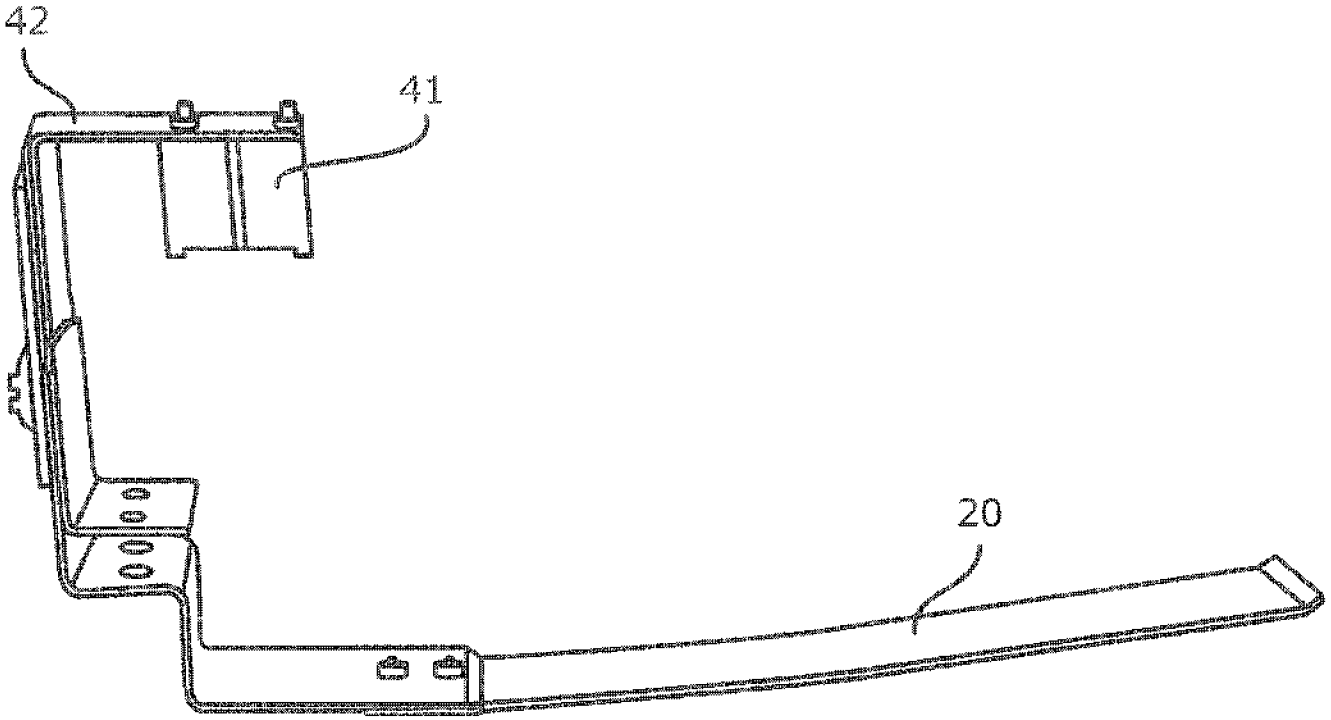
FIG. 5 is a schematic perspective view illustrating the principal portion of the recording apparatus according to the first embodiment of the invention.
Figure 6:
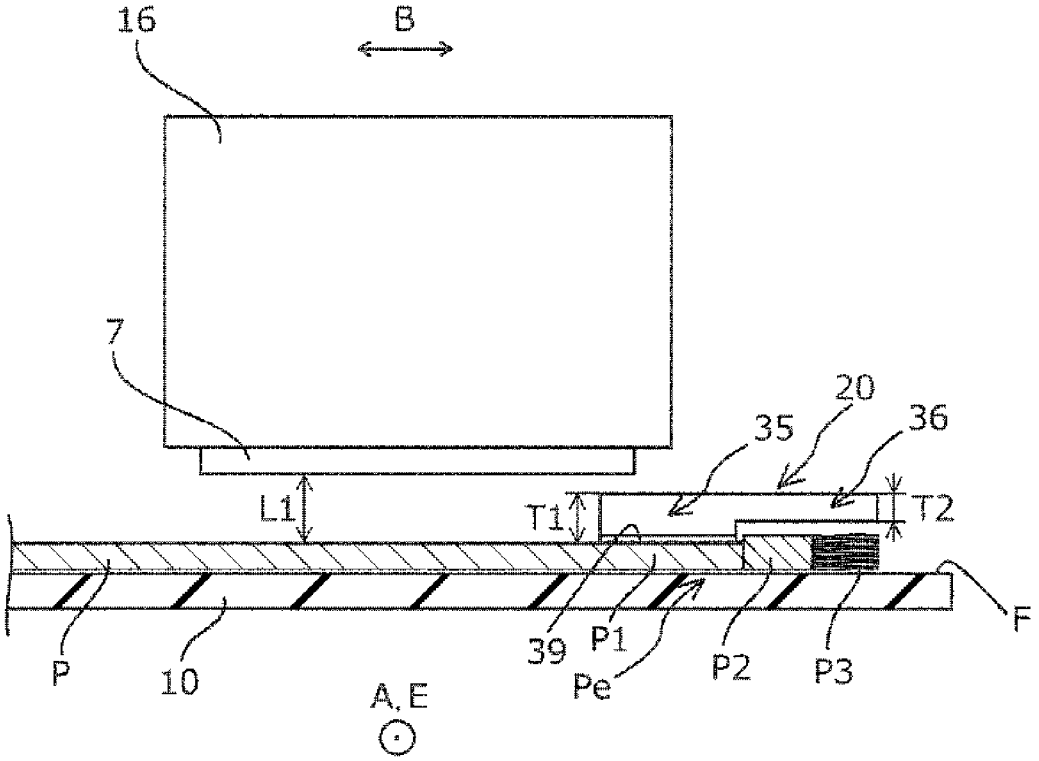
FIG. 6 is a schematic cross-sectional front view illustrating the principal portion of the recording apparatus according to the first embodiment of the invention.

FIG. 3 is a schematic cross-sectional side view illustrating a circumference portion where the pressing unit 20 of the recording apparatus 1 of the embodiment is provided. FIG. 4 is a schematic cross-sectional perspective view illustrating the circumference portion where the pressing unit 20 of the recording apparatus 1 of the embodiment is provided. FIG. 5 is a schematic perspective view illustrating the pressing unit 20 of the recording apparatus 1 of the embodiment. FIG. 6 is a schematic cross-sectional front view illustrating the circumference portion where the pressing unit 20 of the recording apparatus 1 of the embodiment is provided.

Figure 8:
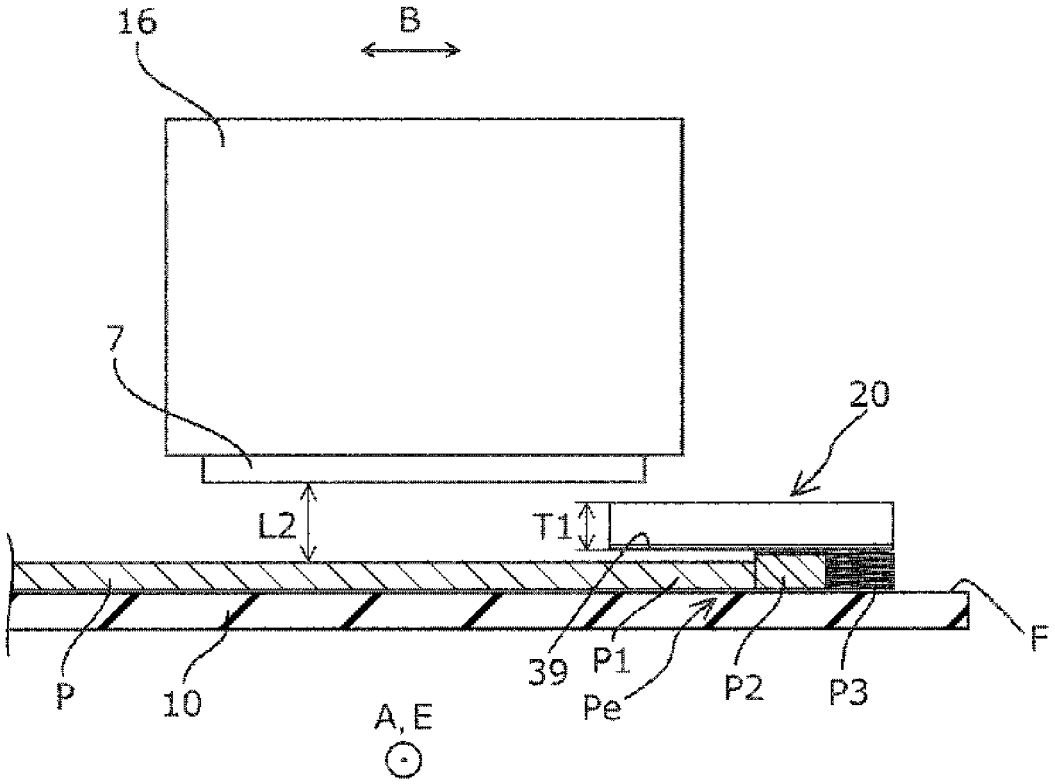
FIG. 8 is a schematic cross-sectional front view illustrating a principal portion of an existing recording apparatus.

FIG. 8 is a schematic cross-sectional front view illustrating a circumference portion where a pressing unit 20 of an existing recording apparatus is provided. Note that FIG. 8 corresponds to FIG. 6.

As shown in FIGS. 3 to 5, the pressing unit 20 of this embodiment is attached to a base body 42, and a magnet holder 41 holding a magnet is also attached to the base body 42.

Further, the carriage case 40 is provided in the recording apparatus 1 of the embodiment, as shown in FIGS. 3 and 4. The carriage case 40 covers the entirety of a movement range of the carriage 16 in the width direction B of the target recording medium P. The movement range of the carriage 16 in the width direction B of the target recording medium P is longer than the width of the target recording medium P. In other words, the structure is such that an end portion of the target recording medium P is covered by the carriage case 40 with certainty.

The carriage case 40 is made of metal and is constituted such that the pressing unit 20 presses the target recording medium P against the support surface F of the adhesive belt 10 by the magnet holder 41 being attached to the carriage case 40 through making use of magnetic force, as shown in FIGS. 3 and 4. Here, since the entirety of the carriage case 40 of the embodiment is made of metal that can be attached to the magnet, the magnet holder 41 can be attached thereto at an arbitrary position in the width direction B of the target recording medium P.

The pressing unit 20 is formed in a plate-like shape, and is what is called a plate spring that is capable of pressing the target recording medium P against the support surface F of the adhesive belt 10 with an adequate force by making use of its bending property. Further, as shown in FIGS. 3 and 4, a region in which the pressing unit 20 presses the medium against the support surface F of the adhesive belt 10 includes a range of a region S opposing the recording head 7.

The recording apparatus 1 of the embodiment includes the adhesive belt 10 as a support unit configured to support the target recording medium P, and the recording head 7 as an ejection unit configured to eject ink onto the target recording medium P that is transported while being supported by the adhesive belt 10.

Further, as shown in FIG. 6, the pressing unit 20 of the embodiment that is formed in a plate-like shape presses, against the adhesive belt 10, an end portion Pe in the width direction B intersecting with the transport direction A of the target recording medium P being transported in the region S opposing the recording head 7. Furthermore, as shown in FIG. 6, the pressing unit 20 includes a thick region 35 with a thickness T1 and a thin region 36 with a thickness T2. To rephrase, the pressing unit 20 includes the regions 35 and 36 with different distances to the adhesive belt 10 via the target recording medium P (that is, with or with the possibility of the target recording medium P being between the pressing unit 20 and the adhesive belt 10).

As discussed above, because the pressing unit 20 of the embodiment includes the regions 35 and 36 with different distances to the adhesive belt 10 via the target recording medium P, relatively thick portions P2 and P3 in the end portion Pe of the target recording medium P can be pressed by the region 36 of the pressing unit 20 with a long distance to the adhesive belt 10 while a relatively thin portion P1 in the end portion Pe of the target recording medium P can be pressed by the region 35 of the pressing unit 20 with a short distance to the adhesive belt 10. This makes it possible to press the end portion Pe of the target recording medium P against the adhesive belt 10 with certainty while suppressing a situation where a distance L1 between the target recording medium P and the recording head 7 becomes long by causing only the region 36 corresponding to the relatively thick portions P2 and P3 in the end portion Pe of the target recording medium P to be thinned without forming the overall pressing unit 20 in a thin plate-like shape.

The expression "to include the regions 35 and 36 with different distances to the adhesive belt 10 via the target recording medium P" means that the pressing unit 20 includes a region with a short distance to the adhesive belt 10 (region 35) and a region with a long distance to the adhesive belt 10 (region 36) in the case where the target recording medium P is pressed against the adhesive belt 10 in a state of the target recording medium P being supported by the adhesive belt 10. The term "distance" herein refers to a distance between the adhesive belt 10 and the pressing unit 20. As such, in a state of the target recording medium P being not supported by the adhesive belt 10, the region 35 of the pressing unit 20 with the short distance to the adhesive belt 10 may make contact with the adhesive belt 10 so that the distance between the pressing unit 20 and the adhesive belt 10 may not be substantially present.

The target recording medium P of this embodiment is a fabric, and a fabric as the target recording medium P generally includes a reinforcement portion P2, a fluff portion P3, and the like in the end portion Pe. Moreover, the reinforcement portion P2 and the fluff portion P3 are thicker than other portions.

Meanwhile, in the existing recording apparatus, as shown in FIG. 8, because the thickness of a pressing unit 20 is constant and the press unit 20 makes contact with the relatively thick portions P2 and P3 in the end portion Pe of the target recording medium P, a distance L2 between the target recording medium P and the recording head 7 becomes long. In FIG. 8, in the case where the thickness of the pressing unit 20 is taken as a thickness T1 in order to press the target recording medium P against the adhesive belt 10 with an adequate force, the distance L2 between the target recording medium P and the recording head 7 is explicitly longer than the distance L1 between the target recording medium P and the recording head 7 in the recording apparatus 1 of the embodiment. Note that FIG. 6 and FIG. 8 illustrate a case where a distance between the pressing unit 20 and the carriage 16 in the recording apparatus 1 of the embodiment shown in FIG. 6 (a distance when the pressing unit 20 and the recording head 7 approach each other to the greatest degree) is equal to a distance between the pressing unit 20 and the carriage 16 in the existing apparatus shown in FIG. 8.

To rephrase the above discussion, by using a recording apparatus 1 of the present embodiment that includes the adhesive belt 10 configured to support the target recording medium P, the recording head 7 configured to eject ink onto the target recording medium P which is transported while being supported by the adhesive belt 10, and the plate-like pressing unit 20 that has the regions 35 and 36 with different distances to the adhesive belt 10 via the target recording medium P and presses, against the adhesive belt 10, the end portion in the width direction B intersecting with the transport direction A of the target recording medium P being transported in the region S opposing the recording head 7, a method for pressing the target recording medium P can be executed in which the region 36 of the pressing unit 20 with the relatively long distance to the adhesive belt 10 presses the relatively thick portions P2 and P3 in the end portion Pe while the region 35 of the pressing unit 20 with the relatively short distance to the adhesive belt 10 presses the relatively thin portion P1 in the end portion Pe.

Accordingly, it is possible to cause only the region 36 corresponding to the relatively thick portions P2 and P3 in the end portion Pe of the target recording medium P to be thinned without forming the overall pressing unit 20 in the thin plate-like shape, and also possible to press the end portion Pe of the target recording medium P against the adhesive belt 10 with certainty while suppressing a situation where the distance L1 between the target recording medium P and the recording head 7 becomes long.

As discussed above, since the pressing unit 20 of the embodiment is the plate spring, the pressing unit 20 is constituted in a simplified manner.

Further, as discussed above, to the carriage case 40 of the embodiment, the magnet holder 41 can be attached at an arbitrary position in the width direction B of the target recording medium P. To rephrase, the pressing unit 20 is so constituted as to be capable of moving along the width direction B of the target recording medium P. This makes it possible to use target recording media P of different widths, and cause the region 36 of the pressing unit 20 with the long distance to the adhesive belt 10 and the region 35 thereof with the short distance to the adhesive belt 10 to precisely correspond to the relatively thick portions P2, P3 and the relatively thin portion P1 in the end portion Pe of the target recording medium P, respectively.

Further, the pressing unit 20 is so constituted as to be capable of moving along the width direction B of the target recording medium P by changing the attachment position thereof through making use of magnetic force. This makes it possible to easily move or detach the pressing unit 20 along with the base body 42 as an attachment section of the pressing unit 20 and the like including the magnet holder 41 as a portion in which the magnet is provided.

Furthermore, as discussed above, the support unit of the embodiment is the adhesive belt 10 configured to support the target recording medium P on the support surface F thereof to which an adhesive agent is attached.

Then, the friction reduction processing is performed in an area of the pressing unit 20 of the embodiment on a side opposing the support surface F so as to form a friction reduction-processed section 39, as shown in FIG. 6.

Because the support unit of the recording apparatus 1 of the embodiment is the adhesive belt 10 configured to support the target recording medium P on the support surface F to which an adhesive agent is attached, the target recording medium P can be fixed and supported with certainty. In addition, in the recording apparatus 1 of the embodiment, friction reduction processing is performed in the area of the pressing unit 20 on the side opposing the support surface F, thereby making it possible to suppress a situation where the pressing unit 20 adheres to the support surface F in a state of the target recording medium P being not supported by the adhesive belt 10.

In this embodiment, as "friction reduction processing", disposing (coating) of a material (fluorine resin) for reducing a coefficient of static friction is carried out in the area on the side opposing the support surface F; however, the invention is not limited thereto. Processing that lessens a contact area with the support surface F so as to reduce the coefficient of static friction (forming unevenness in the surface or the like) may be performed instead.

As shown in FIG. 6, the friction reduction-processed section 39 is formed only on the region 35 of the pressing unit 20 of the embodiment. In other words, in the pressing unit 20 of the embodiment, the friction reduction processing is performed on the region 35 with a relatively short distance to the adhesive belt 10, but not performed on the region 36 with a relatively long distance to the adhesive belt 10. Performing the friction reduction processing tends to increase the thickness of the pressing unit 20. However, by performing the friction reduction processing only on the region 35 with the relatively short distance to the adhesive belt 10, a difference in distance to the adhesive belt 10 between the region 35 with the relatively short distance to the adhesive belt 10 and the region 36 with the relatively long distance thereto (that is, a difference between the thicknesses T1 and T2) can be maintained. This makes it possible, in the case where the target recording medium P having a large thickness difference (large difference in thickness between the relatively thick portions P2, P3 and the relatively thin portion P1) in the end portion Pe is used, to constitute the portion (region 36) corresponding to the relatively thick portions P2, P3 in the end portion Pe of the target recording medium P to be thin, thereby making it possible to suppress an increase in the thickness of the pressing unit 20. In addition, the region 36 with the relatively long distance to the adhesive belt 10 will not make contact with the support surface F, thereby making it also possible to suppress the pressing unit 20 adhering to the support surface F.

Figure 7:
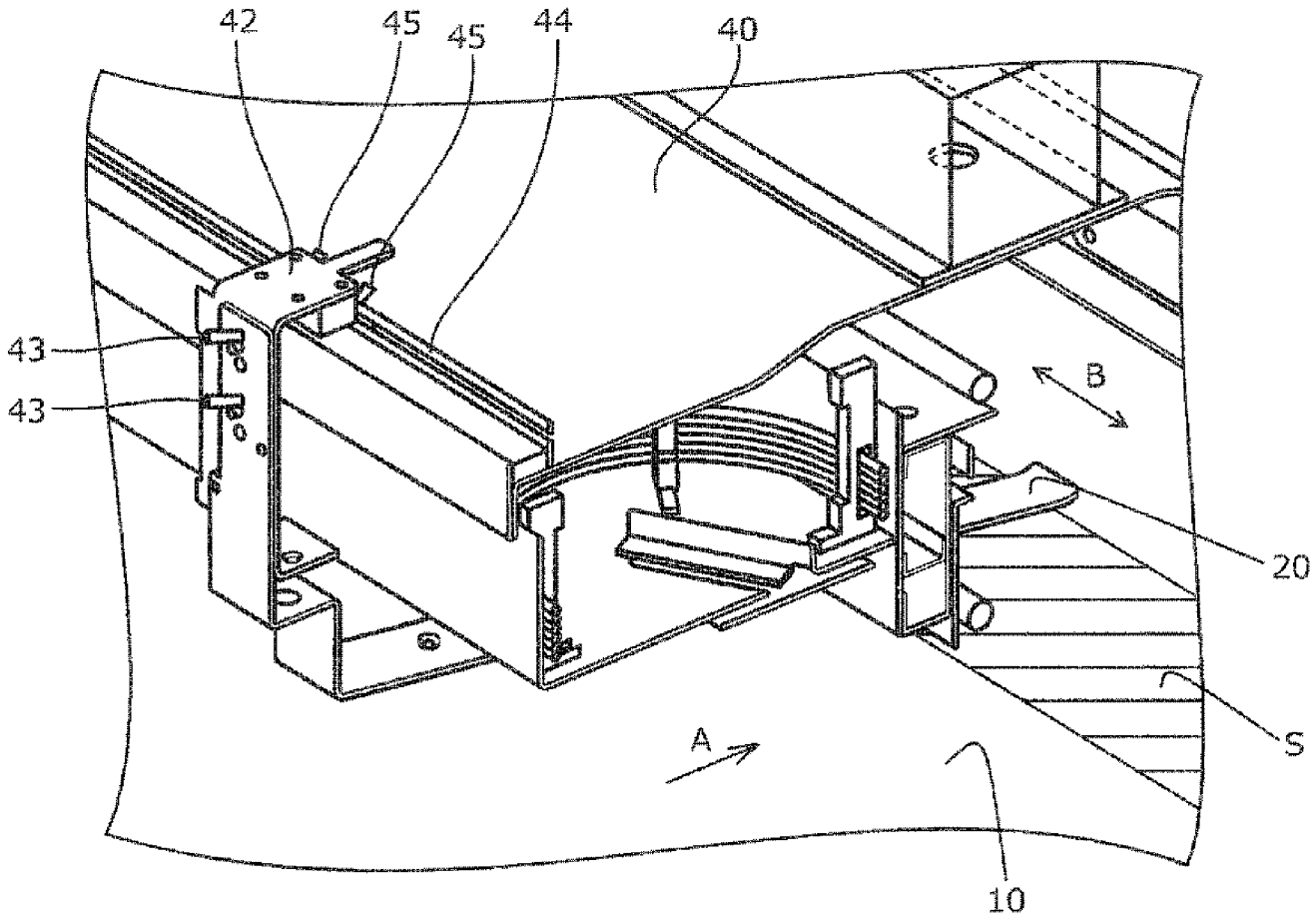
FIG. 7 is a schematic cross-sectional perspective view illustrating a principal portion of a recording apparatus according to a second embodiment of the invention.

Second Embodiment (FIG. 7)

Next, a recording apparatus 1 according to a second embodiment will be described in detail with reference to the accompanying drawings.

FIG. 7 is a schematic cross-sectional perspective view illustrating a circumference portion where a pressing unit 20 as a principal portion of the recording apparatus 1 of the second embodiment is provided. Note that FIG. 7 corresponds to FIG. 4 of the recording apparatus 1 according to the first embodiment.

The recording apparatus 1 of the second embodiment has the same structure as the recording apparatus 1 of the first embodiment except for a structure of the pressing unit 20 and its circumference portion. As such, the same constituent members as those in the recording apparatus 1 of the first embodiment are indicated by the same reference numerals.

In the recording apparatus 1 of the first embodiment, the pressing unit 20 is attached to the base body 42 to which the magnet holder 41 is attached, and is so constituted as to be capable of moving in the width direction B of the target recording medium P and capable of being detached from the recording apparatus 1, along with the magnet holder 41 and the base body 42.

Meanwhile, in the recording apparatus 1 of the second embodiment, as shown in FIG. 7, a slide rail 44 is provided along the width direction B of the target recording medium P, and the base body 42 is fastened to the slide rail 44 with screws 45 and the pressing unit 20 is fastened to the base body 42 with screws 43. With this structure, the pressing unit 20 of the embodiment is so constituted as to be capable of moving along the slide rail 44. As such, the recording apparatus 1 of this embodiment is so constituted that the pressing unit 20 can be moved along the slide rail 44 with ease. Further, this structure makes it possible to remove only the pressing unit 20 with ease by removing the screws 43 and then removing only the pressing unit 20 from the slide rail 44.

Note that the invention is not limited to the above embodiments, and various modifications can be made within the scope of the invention as defined in the claims; and it goes without saying that such modifications are also encompassed in the scope of the invention.

This application claims priority under 35 U.S.C. § 119 to Japanese Patent Application No. 2016-075617, filed Apr. 5, 2016. The entire disclosure of Japanese Patent Application No. 2016-075617 is hereby incorporated herein by reference.

What is claimed is:

1. A liquid ejecting apparatus comprising:

a support unit configured to support a medium;

an ejection unit configured to eject a liquid onto the medium that is transported while being supported by the support unit; and a plate-like pressing unit configured to press, against the support unit, an end portion in a width direction intersecting with a transport direction of the medium being transported in a region opposing the ejection unit, wherein the pressing unit, at a portion that contacts the medium, includes regions in the width direction with different distances from the portion that contacts the medium to the support unit via the medium.

2. The liquid ejecting apparatus according to claim 1, wherein the pressing unit is a plate spring.

3. The liquid ejecting apparatus according to claim 1, wherein the pressing unit is so constituted as to be capable of moving along the width direction.

4. The liquid ejecting apparatus according to claim 3, wherein the pressing unit is so constituted as to be capable of moving along the width direction by changing an attachment position thereof through making use of magnetic force.

5. The liquid ejecting apparatus according to claim 3, wherein the pressing unit is so constituted as to be capable of moving along a slide rail that is provided along the width direction.

6. The liquid ejecting apparatus according to claim 1, wherein the support unit is an adhesive belt configured to support the medium on a support surface thereof to which an adhesive agent is attached, and friction reduction processing is performed on a side of the pressing unit that opposes the support surface.

7. The liquid ejecting apparatus according to claim 6, wherein the friction reduction processing is performed on the region with the relatively short distance to the support unit, but not performed on the region with the relatively long distance to the support unit.

8. A method for pressing a medium in a liquid ejecting apparatus that includes a support unit configured to support the medium, an ejection unit configured to eject a liquid onto the medium which is transported while being supported by the support unit, and a plate-like pressing unit configured to press, against the support unit, an end portion in a width direction intersecting with a transport direction of the medium being transported in a region opposing the ejection unit, the method comprising:

using the pressing unit with regions, at a portion that contacts the medium (P) and in the width direction, with different distances from the portion that contacts the medium (P) to the support unit via the medium; and causing a region of the pressing unit with the relatively long distance to the support unit to press a relatively thick portion in the end portion of the medium and a region of the pressing unit with the relatively short distance to the support unit to press a relatively thin portion in the end portion of the medium.

* * * * *